US009314840B2

(12) United States Patent
Wagstaff et al.

(10) Patent No.: US 9,314,840 B2
(45) Date of Patent: Apr. 19, 2016

(54) INTERMITTENT MOLTEN METAL DELIVERY

(71) Applicant: NOVELIS INC., Atlanta, GA (US)

(72) Inventors: Robert Bruce Wagstaff, Greenacres, WA (US); David Sinden, Valleyford, WA (US)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 14/693,610

(22) Filed: Apr. 22, 2015

(65) Prior Publication Data

US 2015/0224573 A1 Aug. 13, 2015

Related U.S. Application Data

(62) Division of application No. 14/205,183, filed on Mar. 11, 2014.

(60) Provisional application No. 61/777,574, filed on Mar. 12, 2013.

(51) Int. Cl.

| | |
|---|---|
| ***B22D 11/18*** | (2006.01) |
| ***B22D 37/00*** | (2006.01) |
| ***B22D 7/00*** | (2006.01) |
| ***B22C 9/00*** | (2006.01) |
| ***B22D 21/04*** | (2006.01) |
| ***B22D 46/00*** | (2006.01) |

(52) U.S. Cl.

CPC . *B22D 37/00* (2013.01); *B22C 9/00* (2013.01); *B22D 7/005* (2013.01); *B22D 11/181* (2013.01); *B22D 21/04* (2013.01); *B22D 46/00* (2013.01)

(58) Field of Classification Search

CPC ..... B22D 11/181; B22D 37/00
USPC ..... 164/154.5, 449.1–450.5, 451–453
See application file for complete search history.

(56) References Cited

U.S. PATENT DOCUMENTS

| | | | | |
|---|---|---|---|---|
| 4,498,521 | A * | 2/1985 | Takeda et al. | 164/453 |
| 4,523,624 | A | 6/1985 | Dantzig et al. | |
| 4,583,717 | A * | 4/1986 | Hasegawa et al. | 266/44 |

(Continued)

FOREIGN PATENT DOCUMENTS

| | | | |
|---|---|---|---|
| GB | 2109723 | A | 6/1983 |
| JP | S5935867 | A | 2/1984 |

(Continued)

OTHER PUBLICATIONS

International Patent Application No. PCT/US2014/023772, International Search Report and Written Opinion mailed Jun. 23, 2014, 11 pages.

(Continued)

*Primary Examiner* — Kevin E Yoon
(74) *Attorney, Agent, or Firm* — Kilpatrick Townsend & Stockton LLP

(57) ABSTRACT

Automated processes that dynamically control rate of delivery of molten metal to a mold during a casting process. Such automated processes can use dynamic metal level variation, control pin pulses and/or oscillation during the mold fill and transient portion of the cast. It has been found that such pulses keep metal flowing in a manner that addresses problems, particularly at the beginning of an ingot cast, associated with metal meniscus contracting and pulling away from the mold on the short faces and corners.

15 Claims, 3 Drawing Sheets

(56) References Cited

U.S. PATENT DOCUMENTS

| | | | | |
|---|---|---|---|---|
| 5,119,866 | A | 6/1992 | Mihara | |
| 5,298,887 | A | 3/1994 | Pepping | |
| 5,311,924 | A * | 5/1994 | Asano et al. | 164/453 |
| 5,316,071 | A | 5/1994 | Skinner et al. | |
| 5,339,885 | A | 8/1994 | Sinden et al. | |
| 5,490,554 | A | 2/1996 | Moritz | |
| 5,526,870 | A | 6/1996 | Odegard et al. | |
| 5,678,623 | A | 10/1997 | Steen et al. | |
| 6,216,765 | B1 | 4/2001 | Tseng et al. | |
| 6,289,971 | B1 | 9/2001 | Kagawa | |
| 6,308,767 | B1 | 10/2001 | Hugo et al. | |
| 6,460,595 | B1 | 10/2002 | Benz et al. | |
| 6,631,753 | B1 | 10/2003 | Carter, Jr. et al. | |
| 6,779,588 | B1 | 8/2004 | Good et al. | |
| 6,851,587 | B1 | 2/2005 | Tseng | |
| 7,143,809 | B1 | 12/2006 | Johansen et al. | |
| 7,617,864 | B2 | 11/2009 | Gallerneault | |
| 7,789,124 | B2 | 9/2010 | Gallerneault | |
| 7,882,887 | B2 | 2/2011 | Wagstaff et al. | |
| 8,096,344 | B2 | 1/2012 | Wagstaff et al. | |
| 8,312,915 | B2 | 11/2012 | Anderson et al. | |
| 8,336,603 | B2 | 12/2012 | Bischoff et al. | |
| 8,347,949 | B2 | 1/2013 | Anderson et al. | |
| 8,415,025 | B2 | 4/2013 | Anderson et al. | |
| 2005/0263260 | A1 | 12/2005 | Smith | |
| 2010/0032455 | A1 | 2/2010 | Cooper et al. | |
| 2014/0262119 | A1 | 9/2014 | Wagstaff et al. | |

FOREIGN PATENT DOCUMENTS

| | | | |
|---|---|---|---|
| JP | H03174959 | A | 7/1991 |
| KR | 10-2013-0012451 | A | 2/2013 |
| WO | 2012083452 | A1 | 6/2012 |
| WO | 2014164911 | A1 | 10/2014 |

OTHER PUBLICATIONS

U.S. Appl. No. 14/205,183, Non-Final Office Action filed May 11, 2015, 12 pages.

* cited by examiner

INTERMITTENT MOLTEN METAL DELIVERY

CROSS-REFERENCES TO RELATED APPLICATIONS

This application is a division of U.S. patent application Ser. No. 14/205,183, filed Mar. 11, 2014, entitled "INTERMITTENT MOLTEN METAL DELIVERY", which claims the benefit of U.S. Provisional Patent Application No. 61/777,574, filed Mar. 12, 2013, entitled "INTERMITTENT MOLTEN METAL DELIVERY", the contents of which are incorporated herein by reference in its entirety.

FIELD OF THE INVENTION

The present invention relates to automated processes that dynamically control rate of delivery of molten metal to a mold during a casting process.

BACKGROUND OF THE INVENTION

At the beginning of an ingot cast, such as in an aluminum casting process, it is common in the first 300 mm of the cast for metal meniscus to contract and pull away from the mold on the short faces and corners. This phenomenon can occur for various reasons.

First, there can be inadequate metal flow into the corner and short face, which allows the metal to cool and pull away from the mold surface. Typically this inadequate flow is rectified by designing metal distribution systems which preferentially redistribute metal into these areas or by minimizing butt curl, which has in a roundabout way the tendency to restrict metal flow to the corner and short face.

Second, there can be excessive liquid molten-to-mold interface surface tension, which is typically an aspect of the alloy being cast. Alloys which can experience this problem include Aluminum alloys of Magnesium and/or Lithium. In some cases these alloys can be modified by surface active elements, such as, for example, Strontium, Calcium and Beryllium.

Third, there can be excessively tight corner radii. This problem can sometimes be resolved by using more liberal radii, but with a compromise of ingot scalping and hot line edge recovery. Generally, compromises made for start of the cast dynamics and recovery affect the total ingot recovery negatively in the hotline, where millions and millions of pounds are lost each year.

If such compromises are not made, overall ingot recovery is affected along with the inherent EHS aspect of metal dribbling into the mold to meniscus gap that can potentially create a butt hang-up, which can in turn cause a severe ingot explosion.

In some conventional processes, during curl, 150-250 mm into the cast, operators are continually on the casting table to make sure that the mold to meniscus gap is continually filled. From time to time they intervene and mechanically pull the metal control pin, or shake the pin-bag, to allow a sudden disruption to the metal level system to statically overcome the surface tension effect and "fill in" the corner or short face gap.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Certain embodiments of the invention solve some or all of these problems by using dynamic metal level variation or oscillation (such as by, for example, pulsing the pin or by variation of the metal-level control setpoint) during the mold fill and transient portion of the cast. It has been found that the resulting oscillating metal level, among other things, keeps metal flowing, thus overcoming the "cold corner" effect described above. Among other advantages of certain embodiments, operators no longer need to be on the table in order to overcome such effects, and corner radii compromises are less necessary or obviated.

For a fuller understanding of the nature and advantages of the present invention, reference should be made to the ensuing detailed description and accompanying drawing.

BRIEF DESCRIPTION OF THE DRAWINGS

Various embodiments in accordance with the present disclosure will be described with reference to the drawings, in which.

DETAILED DESCRIPTION OF THE INVENTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

The following description will serve to illustrate certain embodiments of the present invention further without, at the same time, however, constituting any limitation thereof. On the contrary, it is to be clearly understood that resort may be had to various embodiments, modifications, and equivalents thereof which, after reading the description herein, may suggest themselves to those skilled in the art without departing from the spirit of the invention.

Figure 1:
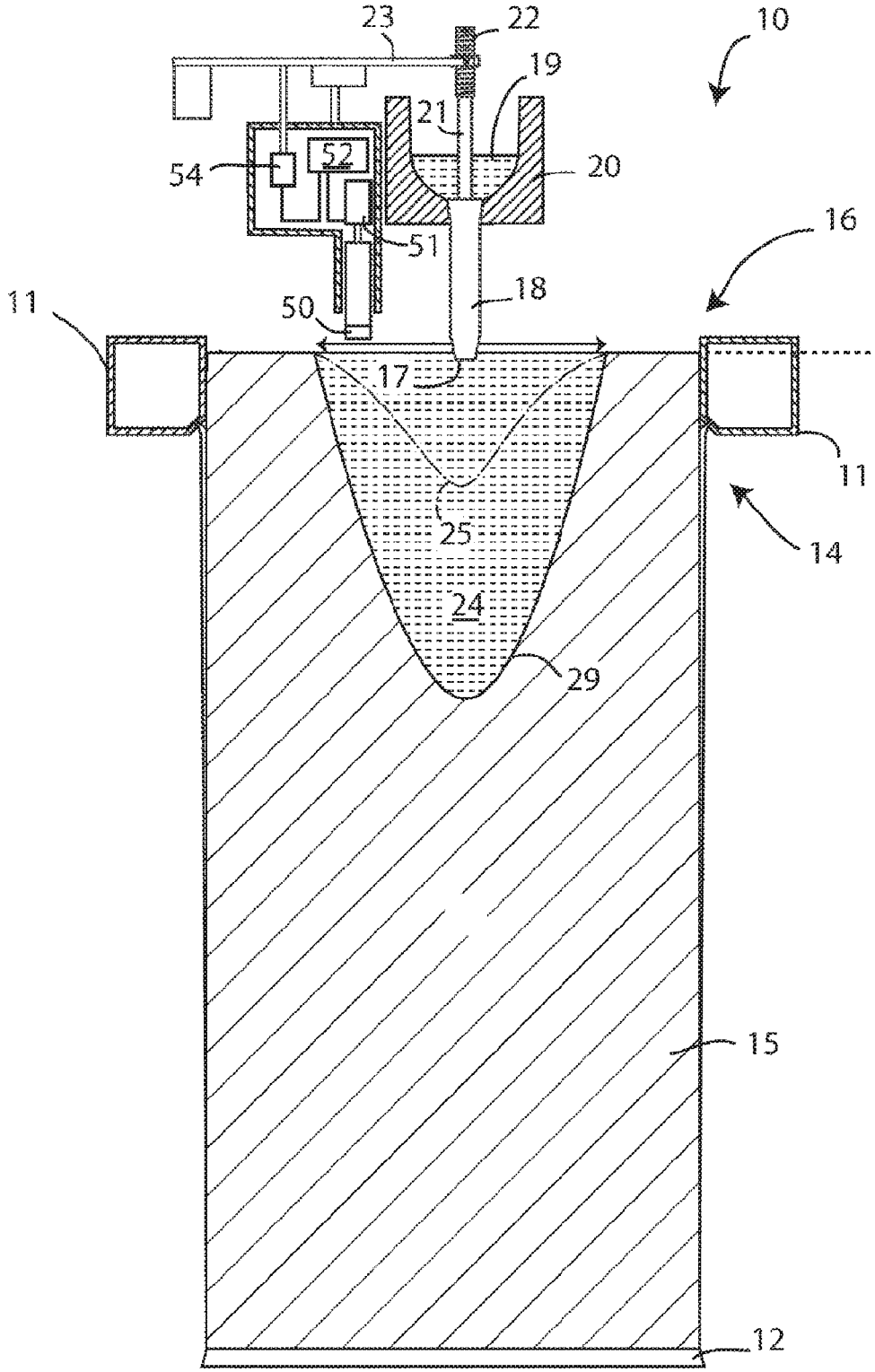
FIG. 1 is a schematic representation of a direct chill casting apparatus as it appears toward the end of a casting operation, according to an embodiment of the invention.

FIG. 1 is a simplified schematic vertical cross-section of an upright direct chill casting apparatus 10, such as is appropriate in connection with certain embodiments of the invention, at the end of a casting operation. Such molds and portions thereof are disclosed in U.S. Pat. No. 8,347,949 issued Jan. 8, 2013 to Anderson, et al. (hereinafter "Anderson") and U.S. Pat. No. 4,498,521 issued Feb. 12, 1985 to Takeda, et al. ("Takeda"), which patents are incorporated herein by this reference. Takeda also discloses processes for conducting casting which may be appropriate for certain embodiments of this invention. With reference to FIG. 1, the apparatus includes a direct chill casting mold 11, preferably of rectangular annular form in top plan view but optionally circular or of other shape, and a bottom block 12 that is moved gradually vertically downwardly by suitable support means (not shown)

during the casting operation from an upper position initially closing and sealing a lower end 14 of the mold 11 to a lower position (as shown) supporting a fully-formed cast ingot 15. The ingot is produced in the casting operation by introducing molten metal into an upper end 16 of the mold through a vertical hollow spout 18 or equivalent metal feed mechanism while the bottom block 12 is slowly lowered. Molten metal 19 is supplied to the spout 18 from a metal melting furnace (not shown) via a launder 20 forming a horizontal channel above the mold.

The spout 18 encircles a lower end of a control pin 21 that regulates and can terminate the flow of molten metal through the spout. In one embodiment, a plug such as a ceramic plug forming a distal end of the pin 21 is received within a tapered interior channel of the spout 18 such that when the pin 21 is raised, the area between the plug and open end of the spout 18 increases, thus allowing molten metal to flow around the plug and out the lower tip 17 of the spout 18. Thus, flow and rate of flow of molten metal may be controlled precisely by appropriately raising or lowering the control pin 21. In addition to the structures shown in Anderson, spout 18 and pin 21 combinations that accomplish such purposes are also disclosed in U.S. Pub. No. 2010/0032455 published Feb. 11, 2010 to James, which publication is incorporated herein by this reference. Any desirable structure or mechanism may be used for control of flow of molten metal in to the mold. For convenience, the terms "conduit," "control pin" and "command signals" that control position of the control pin relative to the conduit are utilized in this document to refer to any mechanism or structure that is capable of regulating flow or flow rate of molten metal into the mold by virtue of command signals from a controller; accordingly, reference in this document (including the claims) to providing command signals to a control pin positioner to regulate molten metal flow or flow rate into a mold will be understood to mean providing command signals to an actuator of whatever type to control flow or flow rate of molten metal into the mold in whatever manner and using whatever structure or mechanism.

In the structure shown in FIG. 1, the control pin 21 has an upper end 22 extending upwardly from the spout 18. The upper end 22 is pivotally attached to a control arm 23 that raises or lowers the control pin 21 as required to regulate or terminate the flow of molten metal through the spout 18. During the casting operation, the control pin 21 is sometimes momentarily held in a raised position by manually grabbing and raising the pin holder 22, which is attached to the pin 21, so that molten metal may run freely and quickly through the spout 18 and into the mold 11. For casting, the launder 20 and spout 18 are lowered sufficiently to allow a lower tip 17 of the spout to dip into molten metal forming a pool 24 in the embryonic ingot to avoid splashing of and turbulence in the molten metal. This minimizes oxide formation and introduces fresh molten metal into the mold. The tip may also be provided with a distribution bag (not shown) in the form of a metal mesh fabric that helps to distribute and filter the molten metal as it enters the mold. At the completion of casting, the control pin 21 is moved to a lower position where it blocks the spout and completely prevents molten metal from passing through the spout, thereby terminating the molten metal flow into the mold. At this time, the bottom block 12 no longer descends, or descends further only by a small amount, and the newly-cast ingot 15 remains in place supported by the bottom block 12 with its upper end still in the mold 11.

Apparatus 10 can include a metal level sensor 50 whose structure and operation is conventional (unlike the sensor 50 described in Anderson, which is connected to an actuator 51 to allow the Anderson sensor to operate in a particular way in order to perform particular processes disclosed and claimed in Anderson). For example, sensor 50 can be structured and operate in the manner in which the float and transducer are structured and operate as disclosed, for example, in Takeda FIG. 1 and column 6, lines 21-52, among other places in Takeda. Alternatively, sensor 50 could be a laser sensor or another type of fixed or movable fluid level sensor having desired properties for accommodating molten metal. During the cavity filling operations, the information from sensor 50 can be fed to the controller 52. The controller 52 can use that data among other data to determine when the control pin 21 is to be raised and/or lowered by actuator 54 so that metal may flow into the mold 11 to fill a partial cavity, i.e. when the depth of the predetermined cavity reaches a predetermined limit. Thus, the sensor 50 and actuator 54 are coupled with controller 52, as shown in FIG. 1, to allow information from sensor 50 to be used in connection with positioning of control pin 21 under control of actuator 54 and thereby control flow and/or flow rate of metal into the mold 11. In a preferred embodiment, controller 52 is a proportional-integral-derivative (PID) controller, which may be a conventional PID controller, or a PID controller that is implemented as desired digitally and programmably.

Figure 2:
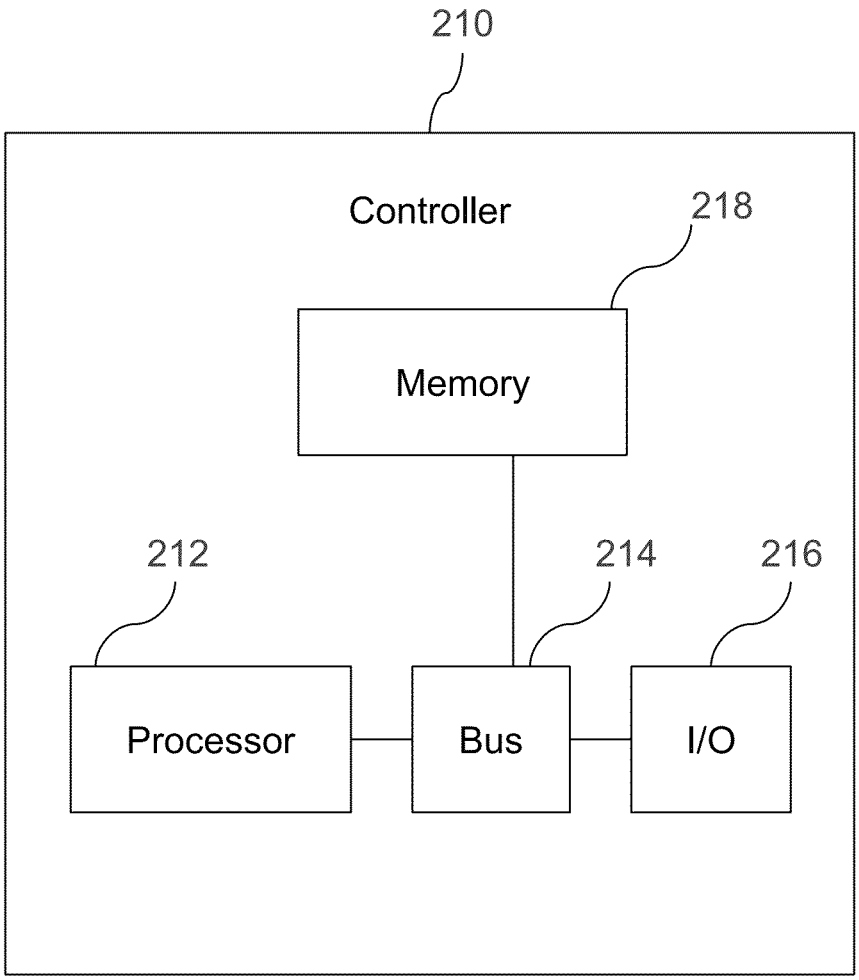
FIG. 2 is a schematic representation of a digitally and programmably implemented controller according to an embodiment of the invention.

FIG. 2 is an example of a controller 210 that is implemented digitally and programmably using conventional computer components, and that may be used in connection with certain embodiments of the invention, including equipment such as shown in FIG. 1, to carry out processes of such embodiments. The controller 210 includes a processor 212 that can execute code stored on a tangible computer-readable medium in a memory 218 (or elsewhere such as portable media, on a server or in the cloud among other media) to cause the controller 210 to receive and process data and to perform actions and/or control components of equipment such as shown in FIG. 1. The controller 210 may be any device that can process data and execute code that is a set of instructions to perform actions such as to control industrial equipment. Controller 210 can take the form of a digitally and programmably implemented PID controller, a programmable logic controller, a microprocessor, a server, a desktop or laptop personal computer, a laptop personal computer, a handheld computing device, and a mobile device.

Examples of the processor 212 include any desired processing circuitry, an application-specific integrated circuit (ASIC), programmable logic, a state machine, or other suitable circuitry. The processor 212 may include one processor or any number of processors. The processor 212 can access code stored in the memory 218 via a bus 214. The memory 218 may be any non-transitory computer-readable medium configured for tangibly embodying code and can include electronic, magnetic, or optical devices. Examples of the memory 218 include random access memory (RAM), read-only memory (ROM), flash memory, a floppy disk, compact disc, digital video device, magnetic disk, an ASIC, a configured processor, or other storage device.

Instructions can be stored in the memory 218 or in processor 212 as executable code. The instructions can include processor-specific instructions generated by a compiler and/or an interpreter from code written in any suitable computer-programming language. The instructions can take the form of an application that includes a series of setpoints, parameters for the casting process, and programmed steps which, when executed by processor 212, allow controller 210 to control flow of metal into a mold, such as by using the molten metal level feedback information from sensor 50 in combination with metal level setpoints and other casting-related parameters which may be entered into controller 210 to control actuator 54 and thereby position of pin 21 in spout 18 in the apparatus shown in FIG. 1 for controlling flow and/or flow rate of molten metal into mold 11.

The controller 210 includes an input/output (I/O) interface 216 through which the controller 210 can communicate with devices and systems external to the controller 210, including sensor 50, actuator 54 and/or other mold apparatus components. Interface 216 can also if desired receive input data from other external sources. Such sources can include control panels, other human/machine interfaces, computers, servers or other equipment that can, for example, send instructions and parameters to controller 210 to control its performance and operation; store and facilitate programming of applications that allow controller 210 to execute instructions in those applications to control flow of metal into a mold such as in connection with the processes of certain embodiments of the invention; and other sources of data necessary or useful for controller 210 in carrying out its functions to control operation of the mold, such as mold 11 of FIG. 1. Such data can be communicated to I/O interface 216 via a network, hardwire, wirelessly, via bus, or as otherwise desired.

Figure 3:
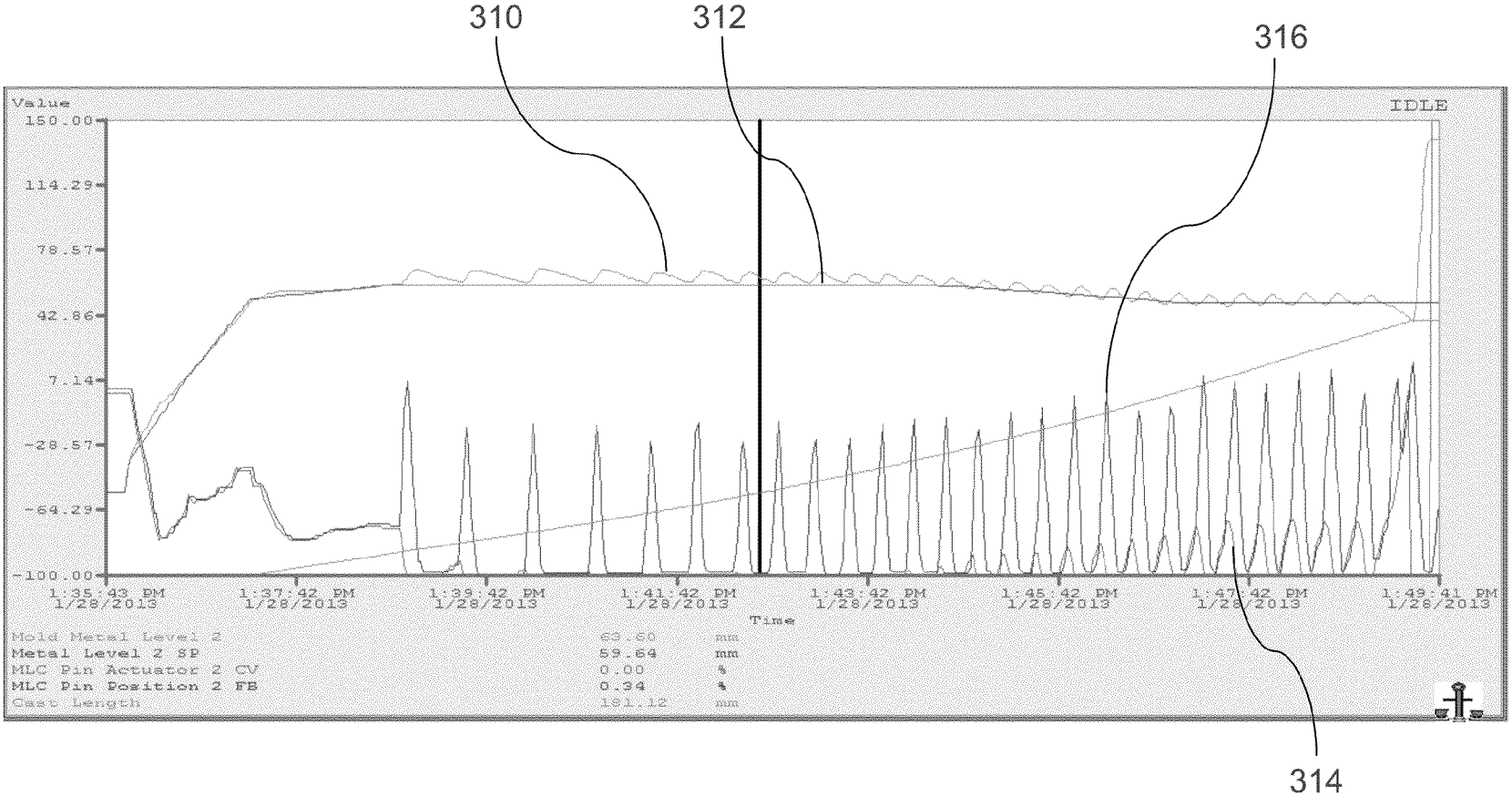
FIG. 3 is a pin pulse trend chart in connection with a process conducted according to an embodiment of the invention.

FIG. 3 shows a pin pulsing trend chart for one direct chill aluminum casting process conducted in accordance with one embodiment of the invention. The chart shows actual metal level (numeral 310); metal level setpoint (312), the command to the pin positioner (from the PID algorithm in the controller) (314), and actual pin positioner position feedback (316). (The vertical scale in this graphic corresponds to the metal level setpoint 312.) Pulsing started at a cast length of 50 mm, and remained active for the duration until the cast ended at 500 mm.

In the embodiment shown in FIG. 3, during pulsing, the actual analog signal to the pin is in the form of square pulses set to 100%, bypassing the command signal from the PID algorithm. This square wave is not apparent in FIG. 3, but it corresponds generally in time and duration to time and duration of pin positioner pulses 316. The fact that the analog signal bypasses the command signal from the PID algorithm is apparent, as shown by the metal level being consistently above the setpoint for about the first 50% of the time after pulsing commences. Under those conditions, the PID controller would ordinarily output a 0% open pin position command in an attempt to stop metal from flowing into the mold. In actual application according to some embodiments, this would not be allowed since an open pin position command that is below a predetermined value for a predetermined period of time, such as 0% open pin position or below 1% open pin position for 5 seconds, constitutes an ingot hangup condition and activates an ingot hangup alarm. An ingot hangup is where the ingot gets stuck in the mold, which can occur due to excessive butt curl during the early part of the cast between about 50 and 400 mm of cast length. The conditions that constitute the ingot hangup and that activate the ingot hangup alarm can vary somewhat between plants, and normally result in an automatic abort of the cast. However, during the process charted in FIG. 3, this alarm was disabled temporarily.

In the particular embodiment charted in FIG. 3, the pulsing frequency varies over time. This variation is due to the pulsing algorithm restricting pulsing to occur only if the actual metal level is no higher than 1 mm above setpoint. Also, in this particular example the pulsing frequency is set to 3 pulses/minute (or less if metal level conditions are not met).

Although FIG. 3 relates to one process according to one embodiment of the invention, it is not necessarily representative of certain other embodiments, which could be performed as follows:

1. In some embodiments, control pin pulsing occurs in a manner that modulates flow or flow rate of molten metal through the conduit such that the level of molten metal in the mold remains in a molten metal level range of between 5 mm above and 3 mm below, inclusive, the metal level setpoint, and preferably in a molten metal level range of between 3 mm above and 1 mm below, inclusive, the metal level setpoint. Preferably, in the preferred molten metal level range, the metal level will rise to about 3 mm above setpoint as a result of each pulse, and between pulses (prior to the next pulse) will typically drop to about 1 mm below setpoint under the control of the PID algorithm as a result of undershoot.

2. In some embodiments, pulsing occurs at a frequency of 3-4 pulses/min, inclusive, or a minimum of 15-20 seconds between pulses, inclusive.

3. In some embodiments, pulsing will be allowed to occur only if the actual metal level is at or below the metal level setpoint AND the command signal to the pin positioner is above a predetermined value (for example greater than 5% open pin position, such that the hangup alarm logic will not be adversely affected).

4. In some embodiments, during pulsing, the actual command signal to the pin positioner is preferably set to 100% open pin position for a duration of preferably about 3 seconds, which period may be larger or smaller, after which it will return to control under the PID algorithm. The pin positioner takes time to open/close and thus can only open to between 30% and 50% open in 3 seconds. In some embodiments, depending on characteristics of the particular control pin positioner at issue, the command signal to the pin positioner is set to open pin position for a longer or shorter period that is at least partially a function of how quickly the pin positioner can open and/or close.

5. In some embodiments, pulsing will begin at a cast length of 50 mm.

6. In some embodiments, pulsing will end when the cast length reaches, preferably, between 400 and 500 mm.

Pin pulsing can be accomplished in any number of alternative ways according to various embodiments of the invention. For instance, pulsing could be accomplished by time-varying the metal level setpoint, or by time-varying sinusoidally the pin positioner command signal about the PID control value (by adding a sinusoidal signal to the PID output control value).

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A mold apparatus for casting metal, comprising:

a mold;

a conduit configured to deliver molten metal to the mold, the conduit controllably occluded by a control pin;

a positioner coupled to the control pin;

a level sensor configured to sense level of molten metal in the mold; and a controller coupled with the control pin positioner and the level sensor, the controller programmed to:

accept input in the form of at least a metal level setpoint; and provide to the positioner, a command signal that includes a plurality of pulses that modulate flow or flow rate of molten metal through the conduit such that the level of molten metal in the mold remains in a molten metal level range of between 5 mm above and 3 mm below, inclusive, the metal level setpoint and such that the level of the molten metal in the mold is increased so as to exceed the metal level setpoint by less than 5 mm above the metal level setpoint as a result of each pulse of the plurality of pulses.

2. An apparatus according to claim 1 wherein the controller is configured to provide to the positioner, a command signal that includes a plurality of pulses that modulate flow or flow rate of molten metal through the conduit such that the level of molten metal in the mold remains in a molten metal level range of between 3 mm above and 1 mm below, inclusive, the metal level setpoint.

3. An apparatus according to claim 1 wherein the controller is configured to provide to the positioner, a command signal that includes a plurality of pulses at a frequency of between 3 and 4 pulses per minute, inclusive, or a plurality of pulses with a minimum of between 15 and 20 seconds between pulses, inclusive.

4. An apparatus according to claim 1 wherein the molten metal is molten aluminum.

5. An apparatus according to claim 4 wherein the controller is configured to provide a command signal wherein the pulses begin at a cast length of 50 mm.

6. An apparatus according to claim 4 wherein the controller is configured to provide a command signal wherein the pulses end when the cast length is between 400 and 500 mm.

7. An apparatus according to claim 1 wherein the controller is a proportional-integral-derivative (PID) controller that includes a PID algorithm for casting of aluminum, the controller configured to accept or determine at least one metal level setpoint.

8. An apparatus according to claim 7 wherein the controller is configured to provide a command signal wherein the pulses occur only if (1) the level of molten metal in the mold is at or below a predetermined metal level setpoint AND (2) the controller is not sending a command signal to the positioner of less than or equal to 5% open.

9. An apparatus according to claim 7 wherein the controller is configured to provide a command signal wherein the pulses occur only if (1) the level of molten metal in the mold is at or below a predetermined metal level setpoint AND (2) the controller is not sending a command signal that causes the controller to issue a hangup alarm signal.

10. An apparatus according to claim 7 wherein the controller is configured to set the command signal to 100% open for a duration of 3 seconds during a pulse, after which the command signal returns to control under the PID algorithm.

11. An apparatus according to claim 1 wherein the positioner is configured, in response to at least some of the command signal pulses, to open to between 30% and 50% open in 3 seconds.

12. An apparatus according to claim 1 wherein the controller is configured to cause the level of the molten metal in the mold to rise to about 3 mm above metal level setpoint as a result of each pulse, and between pulses, prior to the next pulse, to drop to about 1 mm below metal level setpoint under the control of the PID algorithm as a result of undershoot.

13. An apparatus according to claim 1, wherein the command signal is further characterized in that the plurality of pulses modulate flow or flow rate of molten metal through the conduit such that:

between the pulses of the plurality of pulses the level of the molten metal in the mold is maintained less than 3 mm below the metal level setpoint.

14. An apparatus according to claim 2, wherein the command signal is further characterized in that the plurality of pulses modulate flow or flow rate of molten metal through the conduit such that:

the level of the molten metal in the mold is increased so as to exceed the metal level setpoint by less than 3 mm above the metal level setpoint as a result of each pulse of the plurality of pulses.

15. An apparatus according to claim 1, wherein the command signal is further characterized in that the plurality of pulses modulate flow or flow rate of molten metal through the conduit such that:

between the pulses of the plurality of pulses the level of the molten metal in the mold is maintained less than 1 mm below the metal level setpoint.

* * * * *